US005951153A

United States Patent [19]

Favela

[11] Patent Number: 5,951,153

[45] Date of Patent: Sep. 14, 1999

[54] CONVERTIBLE SAFETY TORCHIERE

[76] Inventor: Manuel Favela, 14338 Auburn Ct., Chino Hills, Calif. 91709

[21] Appl. No.: 08/911,297

[22] Filed: Aug. 14, 1997

[51] Int. Cl.[6] ..... F21S 1/12

[52] U.S. Cl. ..... 362/414; 362/376; 362/263; 362/410

[58] Field of Search ..... 362/263, 410, 362/414, 376

[56] References Cited

U.S. PATENT DOCUMENTS 5,725,303 3/1998 Lin ..... 362/376

5,826,975 10/1998 Hsieh et al. ..... 362/414

*Primary Examiner*—Cassandra Spyrou
*Assistant Examiner*—Craig Curtis
*Attorney, Agent, or Firm*—Harry G. Weissenberger

[57] ABSTRACT

A convertible safety torchiere uses a glass-enclosed vertical halogen bulb with a Type A screwthreaded base. The base is screwed into a socket positioned in a frustoconical cup which extends downwardly from the bowl, and a transparent protective dome is mounted on the cup so as to surround the bulb in spaced relationship thereto. A protective funnel spaced from the cup and socket surrounds the cup and socket under the bowl. The Type A socket allows substitution of a standard incandescent bulb for the halogen bulb if desired.

19 Claims, 3 Drawing Sheets

CONVERTIBLE SAFETY TORCHIERE

FIELD OF THE INVENTION

This invention relates to torchieres and more particularly to a torchiere which can use both halogen and conventional incandescent bulbs, and which provides fully transparent heat insulation between the bulb and any flammable object that may be placed over the torchiere.

BACKGROUND OF THE INVENTION

Torchieres have become highly popular lighting devices in recent years, typically due to their low cost and bright yet soft lighting characteristics. Typically, torchieres include a reflective bowl mounted on a pole exceeding the height of a normal adult. A tubular halogen light bulb is horizontally disposed inside the bowl where it cannot be seen by persons in the room, and the very bright light of the halogen lighting element is directed upward so as to reflect from the ceiling with the soft dispersed appearance of indirect lighting.

The halogen lighting elements used in torchieres are typically expensive and hard to install due to their sensitivity to skin oils. Two problems occur in their use: for one, they get extremely hot in use—so hot, in fact, that a flammable fabric draped or blown over the bowl, or a toy thrown into the bowl, will catch fire in a short time. For that reason, Underwriters' Laboratories approval for unprotected halogen lighting elements has been limited to elements not exceeding 150 W, although the market demands at least 300 W elements for sufficient light intensity.

A number of expedients to allow the use of higher-wattage halogen lighting elements have been proposed, such as spacer grids and glass plates supported inwardly of the rim of the bowl to provide a cooling air circulation. None of these solutions are quite satisfactory, however: either the grid itself or the mountings create shadow patterns that detract from the evenness of torchiere lighting. An uneven pattern is also produced by the horizontal orientation of the halogen lighting element.

The horizontal orientation of the conventional halogen lighting element also causes a second problem: Because the center of the horizontal element overlies a non-reflective part of a typical torchiere bowl, about 20% of the light output of the element is lost for indirect lighting purposes. Thus a torchiere with a 300 W, 4800 lumen element actually puts out a usable indirect lighting intensity of only 4200 lumens, which approximately corresponds to the total output of a 250 W element.

Another disadvantage of conventional torchieres is the fact that, due to their cost, spare halogen bulbs are usually not readily available in most households. Therefore, if a bulb burns out, the torchiere is not usable until a replacement bulb has been purchased and installed. This can be awkward or difficult at night, when the torchiere is most likely to be in use.

SUMMARY OF THE INVENTION

The present invention solves the above-mentioned problems of the prior art and obtains the illumination intensity of a 300 W horizontal element by providing a torchiere using a vertically oriented 250 W glass-enclosed JDD halogen bulb with a standard Type A screwthreaded light bulb base. The glass-enclosed bulb is in turn positioned in a glass dome so mounted on the torchiere, in spaced relation to the bulb, as to provide ventilation of the bulb while holding any foreign object at a distance sufficient to prevent fire or injury without producing a shadow pattern. Injury from touching the hot bulb socket is prevented by a protective funnel surrounding the base in spaced relationship thereto between the bowl and the pole. The dome and socket are dimensioned to allow a conventional light bulb to be temporarily substituted for the halogen bulb if needed.

DESCRIPTION OF THE PREFERRED EMBODIMENT

Like conventional torchieres, the torchiere 10 of this invention includes a pole 12 and a bowl 14. The bowl 14 is conventionally coated on the inside with a reflective paint, but for use in this invention it is preferably deeper, e.g. about 9 cm, than the conventional shallow bowls, so that no part of the inventive structure will protrude above its rim.

Figure 1:
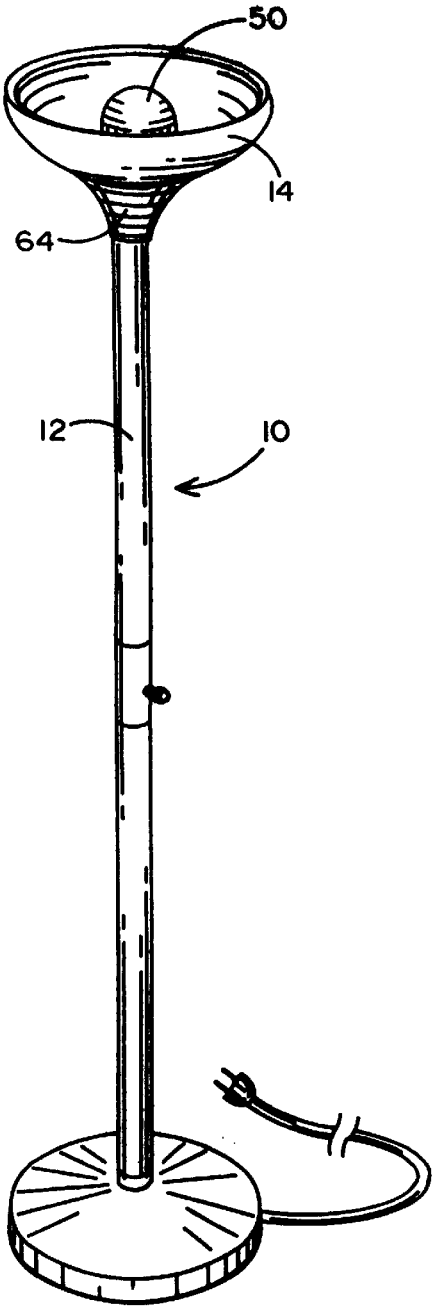
FIG. 1 is a perspective view of the inventive torchiere.
Figure 2A:
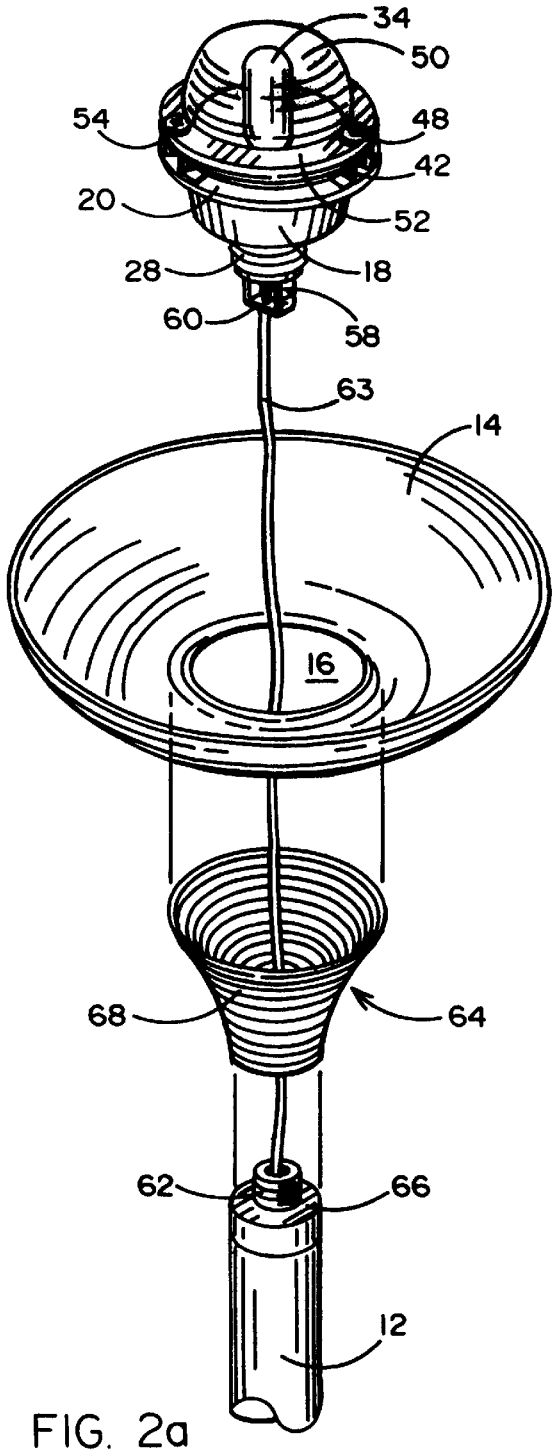
FIG. 2*a* is an exploded perspective view of the upper portion of the inventive torchiere.

Seated in the bottom opening 16 (FIG. 2*a*) of the bowl 14 is a generally frustoconical cup 18. The cup 18 has an upper outwardly extending flange 20 which overlies the edge of the opening 16, and a bottom surface 22 (FIG. 3) with a screwthreaded central opening 24 which receives the external threads 26 of a ceramic socket 28. On its inside, the ceramic socket 28 is equipped with metallic screwthreads 30 (FIG. 2*b*) and a conventional base contact (not shown) to receive and energize a standard Type A incandescent light bulb such as the bulb 32 shown in dotted lines in FIG. 3.

In the torchiere 10 of this invention, however, normal operation is accomplished by screwing into the socket 28 a vertical JDD-type halogen bulb 34. The bulb 34 has a screwthreaded base 36 which is dimensioned to engage the screwthreads 30. Overlying the base 36 is a cylindrical ceramic spacer 38 which supports a vacuum-tube-shaped glass envelope 40. A halogen lighting element 41 is mounted vertically inside the envelope 40 at a level at which all its light-emitting area lies above the upper rim of the spacer 38. Halogen bulbs such as the above-described bulb 34 are commercially available.

Figure 2B:
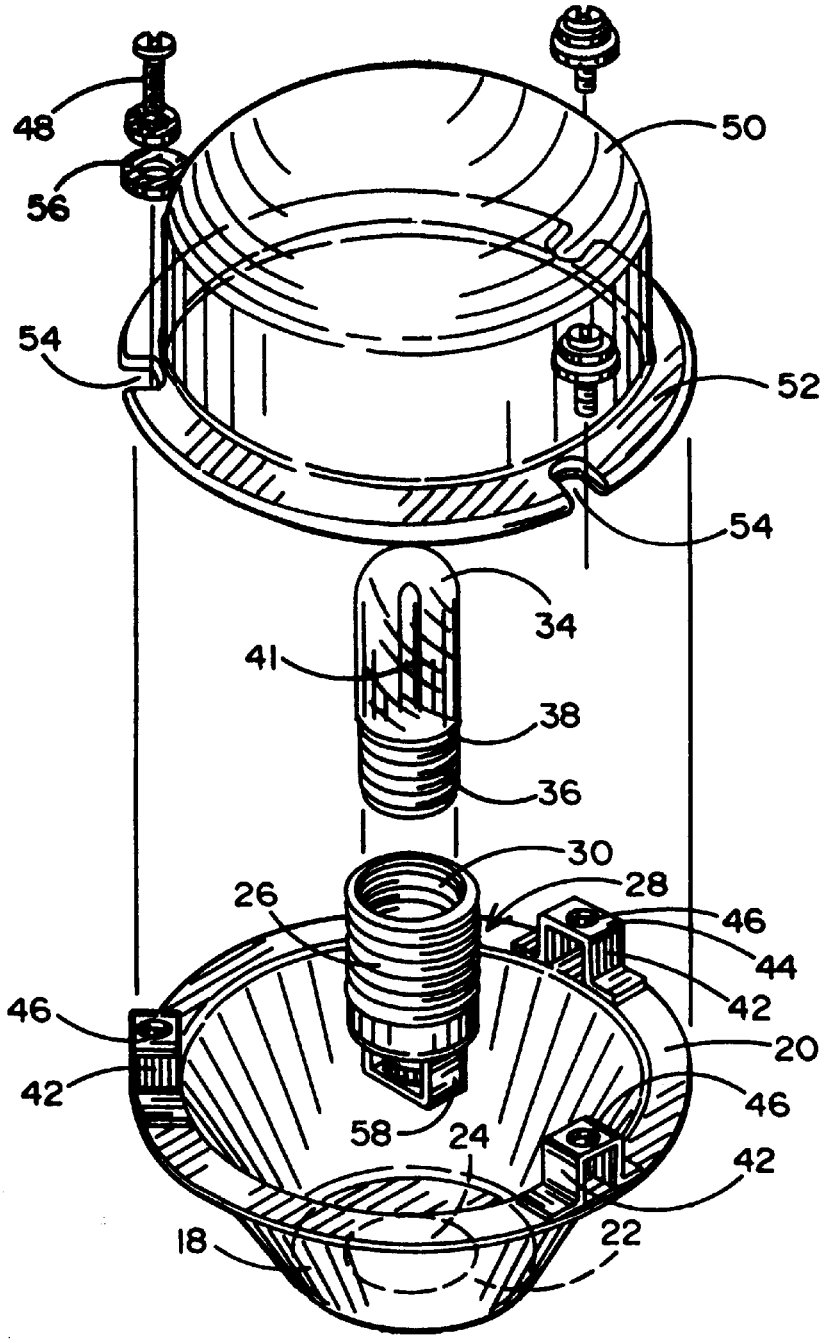
FIG. 2*b* is a detail exploded perspective view of the cup-and-dome assembly of the invention.
Figure 3:
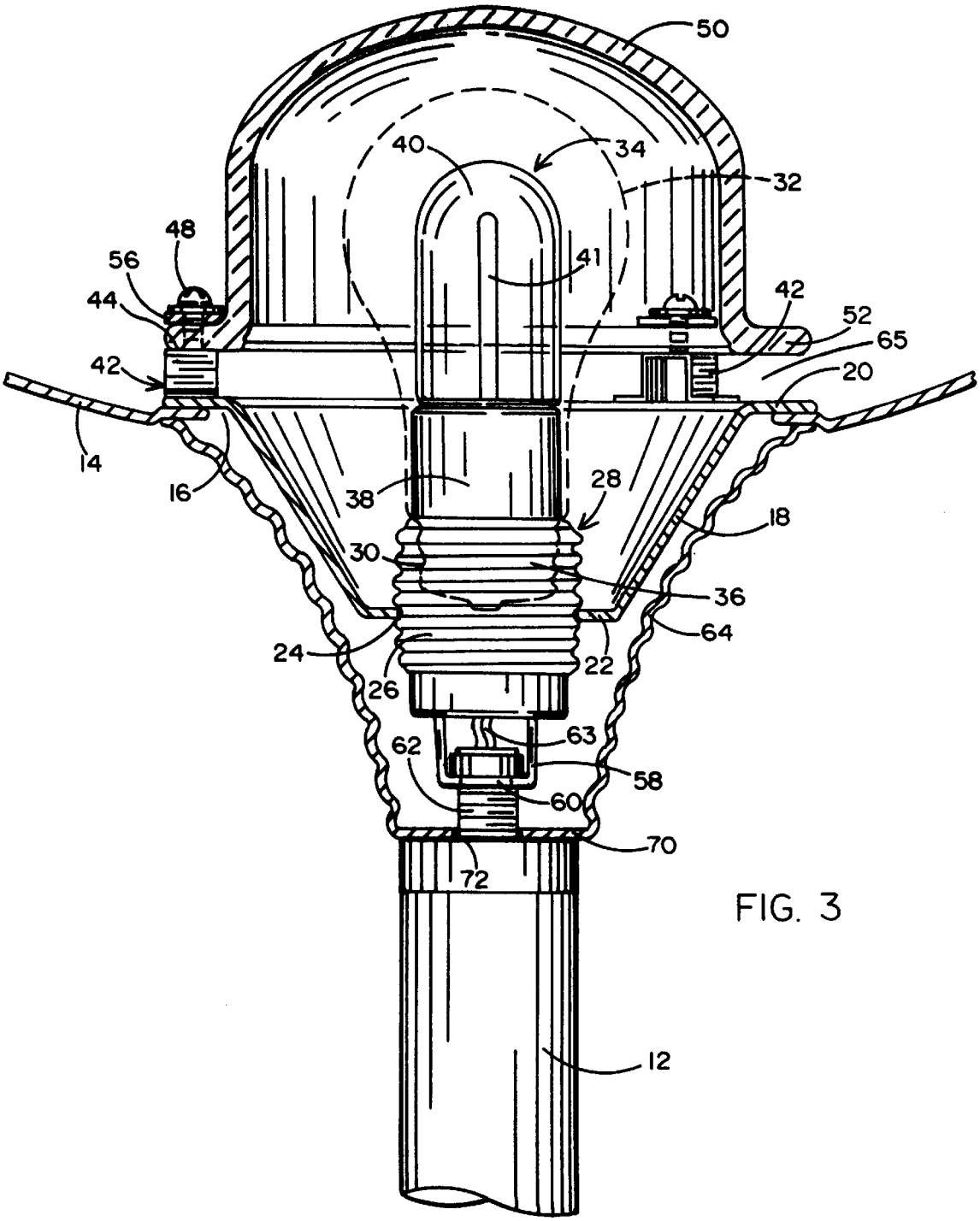
FIG. 3 is an axial vertical detail section of the inventive torchiere.

The flange 20 of the cup 18 carries a plurality (preferably three) of spacer legs 42 whose upper surface 44 has a screwthreaded opening 46 (FIG. 2*b*). The openings 46 receive mounting screws 48 for the dome 50.

The rigid transparent dome 50 is preferably formed of glass or other suitable heat-resistant and heat-insulating material, and is preferably thick enough (about 5 mm) to be rugged in handling and resistant to impacts of foreign objects. The dome 50 is preferably rounded in shape as shown in the drawings, but may be of a cylindrical or other shape as long as the spacing characteristics described below are observed.

The dome 50 has at its bottom an outwardly extending flange 52 in which notches 54 (FIG. 2*b*) are formed in positions corresponding to the locations of the spacer legs 42. The mounting screws 48 extend through these notches and engage the flange 52 to secure the dome 50 to the spacer legs 42. A resilient washer 56 (FIG. 3) is provided between the head of each mounting screw 48 and the flange 52 to allow heat expansion of the flange 52 without stressing the material of dome 50.

The underside of the ceramic socket 28 is equipped with a U-shaped mounting bracket 58 whose center leg has a screwthreaded opening 60 which receives the screwthreaded hollow tip 62 of the pole 12, through which the power supply wire 63 can pass. The cup 18 and the socket 28, which extend below the bowl 14 in the inventive torchiere, are protected from touch by the funnel 64 which is clamped between the bowl 14 and the shoulder 66 of the pole 12. The funnel 64 may have decorative grooves 68 thereon if desired, or for that matter may have any other desired shape that keeps its walls spaced from the cup 18 and socket 28. The funnel 64 has a bottom surface 70 with a central opening 72. Although the funnel 64 can be made of metal, it is preferably made of a heat-insulating material, i.e. a material with low thermal conductivity.

The inventive torchiere is assembled as follows: First, the funnel 64 and the socket 28 are mounted onto the screwthreaded tip 62 of the pole 12 by screwing the bracket 58 onto the tip 62 until it presses the bottom surface 70 of funnel 64 against the shoulder 66 of pole 12, with the opening 72 in the funnel 64 receiving the pole tip 62. The wire 63 connected to the contacts (not shown) of the socket 28 is passed through the hollow tip 62. The wire 63 should be of a type having highly heat-resistant insulation, as the socket 28 gets very hot in use.

Next, the cup 18 is placed into the bowl 14 and is screwed onto the ceramic socket 28 to a depth such that when the halogen bulb 34 is fully screwed into the socket 28, all of the vertical halogen lighting element 41 will lie above the flange 20 of the cup 18. This will direct the maximum amount of light toward the reflective inner surface of bowl 14, thereby producing with a 250 W halogen lighting element the same indirect illumination as a 300 W element in a conventional torchiere. It will be seen that the assembly thus described dictates the height of the funnel 64, which must extend from the shoulder 66 to the underside of bowl 14 when all of the halogen lighting element 41 is above the flange 20 of the cup 18.

The halogen bulb 34 is now screwed into socket 28, whereupon dome 50 can be placed onto the spacer legs 42 and secured thereto by the mounting screws 48.

When so assembled, the torchiere 10 is highly safe. The funnel 64 is preferably wide enough to be laterally spaced by at least 1 cm from the socket 28 and the cup 18. Even if the funnel 64 is made of metal, this is sufficient spacing to maintain the outside of funnel 64 at a temperature sufficiently low to avoid causing burns when touched.

The top of the cup 18 and the dome 50 are preferably no closer than 2–3 cm from the socket 28 and bulb 34 at all points. Also, the spacer legs 42 maintain about a 1 cm annular ventilation gap 65 (FIG. 3) between the cup 18 and the dome 50. As a result, all surfaces in the torchiere 10 that can be touched or contacted by a foreign object are at a temperature of less than 95° C. (not enough to burn fabrics) even though the temperature of the halogen lighting element 41 may be on the order of 250° C., and the temperature of the glass envelope of the halogen bulb 34 and the socket 28 may be on the order of 150° C.

The torchiere 10 has several other advantages. For one, the use of glass-enclosed halogen bulbs 34 with a Type A base allows the bulb 34 to be screwed in like an incandescent bulb without touching the halogen lighting element 41 and possibly damaging it with skin oils.

Secondly, the torchiere 10 of this invention is convertible: If the halogen bulb 34 fails and no spare is immediately available, it can readily be temporarily replaced with a standard incandescent bulb 32 available in most households. The standard incandescent bulb will fit the Type A socket 28 and will be protected by the dome 50. The spacing between the dome 50 and the bulb 32 will be less than the spacing between the dome 50 and the halogen bulb 34, but this is compensated by the lower operating temperature of the incandescent bulb 76. In fact, an incandescent bulb not exceeding 250 W would not need the dome 50 at all.

Thirdly, the dome 50 acts as a lens to intensify the indirect lighting beam projected by the torchiere 10, and the vertical position of the lighting element 41 assures a uniform illumination pattern. With the dome 50 in place, the use of a 250 W JDD-type halogen bulb will satisfy the safety requirements of Underwriters' Laboratories.

It is understood that the exemplary convertible safety torchiere described herein and shown in the drawings represents only a presently preferred embodiment of the invention. Indeed, various modifications and additions may be made to such embodiment without departing from the spirit and scope of the invention. Thus, other modifications and additions may be obvious to those skilled in the art and may be implemented to adapt the present invention for use in a variety of different applications.

I claim:

1. A safety torchiere, comprising:

a) a bowl having an opening in the bottom thereof;

b) a cup having a radially outwardly extending flange at the top thereof;

c) a heat-resistant lamp socket mounted in said cup and laterally spaced from the sides thereof;

d) said flange engaging said bowl along the perimeter of said opening, and said cup and socket extending downwardly through said opening;

e) a rigid, imperforate transparent dome mounted on said flange in vertically spaced relationship thereto;

f) a funnel surrounding said cup and socket in laterally spaced relationship thereto below said bowl; and g) a support pole attachable to said socket, said pole being so configured that said bowl is clamped between said flange and said funnel when said pole is attached to said socket.

2. The torchiere of claim 1, in which said cup is substantially frustoconical in shape.

3. The torchiere of claim 1, further comprising a halogen bulb including a halogen lighting element, a transparent envelope surrounding said lighting element, and a base arranged to be releasably connected to said socket.

4. The torchiere of claim 3, in which said dome substantially surrounds said envelope in spaced relationship thereto.

5. The torchiere of claim 3, in which said lighting element is vertically disposed.

6. The torchiere of claim 3, in which said socket is a Type A light bulb socket, and said halogen bulb has a Type A base.

7. The torchiere of claim 5, in which said halogen bulb is so located with respect to said cup, when connected to said socket, that all of said lighting element lies above said flange, and is surrounded by said dome in spaced relationship thereto.

8. The torchiere of claim 1, in which said dome is mounted on said flange with mounting devices including a heat-resistant, resilient spacing device positioned to allow expansion of the material of said dome without producing mounting stresses.

9. A safety torchiere, comprising:

a) a bowl;

b) a cup depending from said bowl;

c) a heat-resistant bulb-receiving socket mounted in said cup in spaced relationship to the sides thereof;

d) a rigid, imperforate transparent dome mounted in said bowl on said cup and vertically spaced from said cup; and e) a support pole attachable to said socket to support said bowl.

10. The torchiere of claim 9, in which said cup is substantially frustoconical in shape.

11. The torchiere of claim 9, further comprising a halogen bulb including a halogen lighting element, a transparent envelope surrounding said lighting element, and a base arranged to be releasably connected to said socket.

12. The torchiere of claim 11, in which said dome substantially surrounds said envelope in spaced relationship thereto.

13. The torchiere of claim 11, in which said lighting element is vertically disposed.

14. The torchiere of claim 11, in which said socket is a Type A light bulb socket, and said halogen bulb has a Type A base.

15. The torchiere of claim 13, in which said halogen bulb is so located with respect to said cup, when connected to said socket, that all of said lighting element lies above said cup, and is surrounded by said dome in spaced relationship thereto.

16. The torchiere of claim 7, in which said dome has:

i) a flange portion substantially coextensive with said flange of said cup;

ii) a dome portion substantially concentric with the top surface of said envelope when said halogen bulb is connected to said socket; and iii) an annular, substantially vertical wall portion interconnecting said flange portion and said dome portion;

iv) said wall portion and said dome portion being substantially equally spaced from said envelope.

17. The torchiere of claim 16, in which said dome is formed of a heat-resistant and heat-insulating material having a thickness of about 5 mm.

18. The torchiere of claim 15, in which said dome has:

i) a flange portion substantially coextensive with said flange of said cup;

ii) a dome portion substantially concentric with the top surface of said envelope when said halogen bulb is connected to said socket; and iii) an annular, substantially vertical wall portion interconnecting said flange portion and said dome portion;

iv) said wall portion and said dome portion being substantially equally spaced from said envelope.

19. The torchiere of claim 17, in which said dome is formed of a heat-resistant and heat-insulating material having a thickness of about 5 mm.

* * * * *